US009914561B2

(12) United States Patent
Chicca-Hess

(10) Patent No.: US 9,914,561 B2
(45) Date of Patent: Mar. 13, 2018

(54) PRODUCT PACKAGING

(71) Applicant: Paris Presents Incorporated, Gurnee, IL (US)

(72) Inventor: Saundra Chicca-Hess, Highland Park, IL (US)

(73) Assignee: Paris Presents Incorporated, Gurnee, IL (US)

( * ) Notice: Subject to any disclaimer, the term of this patent is extended or adjusted under 35 U.S.C. 154(b) by 456 days.

(21) Appl. No.: 14/593,325

(22) Filed: Jan. 9, 2015

(65) Prior Publication Data

US 2016/0200482 A1 Jul. 14, 2016

(51) Int. Cl.

| | |
|---|---|
| ***B65D 25/24*** | (2006.01) |
| ***B65D 25/54*** | (2006.01) |
| ***B65B 51/04*** | (2006.01) |
| ***B65D 5/66*** | (2006.01) |
| *B65D 67/00* | (2006.01) |
| *B65D 5/42* | (2006.01) |

(52) U.S. Cl.

CPC ..... *B65D 25/54* (2013.01); *B65B 51/04* (2013.01); *B65D 5/6647* (2013.01); *B65D 5/425* (2013.01); *B65D 67/00* (2013.01)

(58) Field of Classification Search

CPC ..... B65D 25/24; B65D 5/425; B65D 67/00
USPC ..... 206/774, 772, 767, 45.28, 45.29, 766, 206/457

See application file for complete search history.

(56) References Cited

U.S. PATENT DOCUMENTS

| | | | | | |
|---|---|---|---|---|---|
| 963,313 | A | | 7/1910 | Nack | |
| 2,490,779 | A | | 12/1949 | Butcher | |
| 3,442,371 | A | * | 5/1969 | Deshong | B65D 11/00 206/45.23 |
| 3,829,008 | A | * | 8/1974 | Murray | B65D 65/06 206/216 |
| 4,353,461 | A | | 10/1982 | Liang | |
| 5,007,530 | A | * | 4/1991 | Weismantel | B65D 5/5206 119/168 |
| 5,794,631 | A | * | 8/1998 | Sylvester | B65D 5/422 206/232 |
| 7,578,393 | B2 | * | 8/2009 | Gillon | B65D 5/4204 206/457 |
| 7,650,996 | B2 | * | 1/2010 | Mark | B65D 25/04 206/772 |
| 9,642,425 | B2 | * | 5/2017 | Tseng | A45C 11/00 |
| 2006/0021906 | A1 | * | 2/2006 | Gillon | B65D 5/4204 206/774 |

(Continued)

*Primary Examiner* — King M Chu

(74) *Attorney, Agent, or Firm* — Quarles & Brady LLP

(57) ABSTRACT

A product packaging (100) and method for packing a product with the product packaging are provided. The product packing includes a container (130), a display aperture (132) in the container (130), a top flap (116) coupled to the container (130), a bottom flap (118) coupled to the container (130), and a fastener (120) coupled to at least one of the top flap (116) or the bottom flap (118). The top flap (116) and the bottom flap (118) are configurable to either cover a portion of the container (130) exclusive of the display aperture (132) when the product packaging (100) is in a display mode, or to cover a portion of the display aperture (132) when the product packaging (100) is in a conceal mode. The fastener (120) is operable to secure at least one of the top flap (116) and the bottom flap (118) when the product packaging (100) in the display mode or the conceal mode.

10 Claims, 5 Drawing Sheets

(56) References Cited

U.S. PATENT DOCUMENTS

| | | | | |
|---|---|---|---|---|
| 2013/0186782 | A1 | 6/2013 | Doyle | |
| 2013/0186896 | A1* | 7/2013 | Doyle | B65D 5/4233 220/259.1 |
| 2013/0341217 | A1 | 12/2013 | Chasan et al. | |

* cited by examiner

PRODUCT PACKAGING

TECHNICAL FIELD

The Application is related to the field of product packaging, and more particularly, to product packaging including a display.

BACKGROUND OF THE APPLICATION

Product packaging is an important part of the consumer products distribution and sales process. Product packaging safely retains consumer products, protecting them from potential damage. In order to protect a consumer product, the product packaging must be strong.

Printed information may be included on the outer surface of a product packaging relating to the item or items therein, such as advertising, manufacturers information, pricing information, to identify products to potential purchases. It is often desirable for at least portion of the product to be visible from outside the packaging, so that a potential purchaser may understand the nature and features of the product.

When a product is purchased as a gift for another, it is often desirable to gift wrap the product before presenting the product to the gift recipient. The gift wrapping serves to hide the contents of the gift so that the gift can be presented as a surprise. The gift wrapping also provides an attractive outer appearance to the gift.

Wrapping a gift may be problematic, however, because it often requires purchasing wrapping paper or other products, incurring extra expense. Gift wrapping also requires that the gift purchaser find the time and space to wrap the gift, which can create unwanted complication, especially if the gift is to be given to a recipient right away.

Finally, for many gift purchasers and recipients, gift wrapping a product is further undesirable because it represents an ecologically wasteful activity.

There is a need for a product packaging that includes an informative display for a potential purchaser, a strong container to protect the product, and a simple and quick means to attractively conceal the product without additional gift wrapping.

SUMMARY OF THE APPLICATION

A product packaging is provided. The product packaging includes a container, a display aperture in the container, a top flap coupled to the container, a bottom flap coupled to the container, and a fastener coupled to at least one of the top flap or the bottom flap. The top flap and the bottom flap are each configurable to either cover a portion of the container exclusive of the display aperture when the product packaging is in a display mode, or to cover a portion of the display aperture when the product packaging is in a conceal mode. The fastener is operable to secure at least one of the top flap and the bottom flap when the product packaging in the display mode or the conceal mode.

A method for packaging a product inside a product packaging in a display mode is provided. The product packaging includes a container, a display aperture in the container, a top flap coupled to the container, a bottom flap coupled to the container, and a fastener coupled to at least one of the top flap or the bottom flap. The method includes the step of placing the product inside the container. The method further includes the step of covering at least a portion of the container exclusive of the display aperture with the top flap and the bottom flap. The method further includes the step of securing at least one of the top flap or the bottom flap with the fastener.

A method for packaging a product inside a container in a conceal mode is provided. The product packaging includes a container, a display aperture in the container, a top flap coupled to the container, a bottom flap coupled to the container, and a fastener coupled to at least one of the top flap or the bottom flap. The method includes the step of placing the product inside the container. The method further includes the step of covering at least a portion of the display aperture with the top flap and the bottom flap. The method further includes the step of securing at least one of the top flap or the bottom flap with the fastener.

ASPECTS

In one embodiment of the product packaging, at least one of the top flap or the bottom flap includes product information visible when the product packaging is in the display mode.

In one embodiment of the product packaging, at least one of the top flap or the bottom flap includes a decorative design visible when the product packaging is in the conceal mode.

In one embodiment of the product packaging, the display aperture includes a plastic cover.

In one embodiment of the product packaging, the top flap and the bottom flap substantially cover the display aperture when the product packaging is in the conceal mode.

In one embodiment of the product packaging, the fastener is operable to secure the top flap and the bottom flap together when the product packaging is in the display mode or the conceal mode.

In one embodiment of the product packaging, the container is a box including a display side having the display aperture, a rear side, a top side, a bottom side, a left side, and a right side.

In one embodiment of the product packaging, the top flap is coupled to the top side of the container and the bottom flap is coupled to the bottom side of the container.

In one embodiment of the product packaging, the top flap includes a top reinforcing portion and the bottom flap includes a bottom reinforcing portion, and the top reinforcing portion supporting the top side of the container and the bottom reinforcing portion supporting the bottom side of the container when the product packaging is in display mode.

In one embodiment of the product packaging, a tab is operable to couple the product packaging to a product display when extended.

In one embodiment of the method for packaging the product inside the product packaging in the display mode, at least one of the top flap or the bottom flap includes product information visible when the product packaging is in the display mode.

In one embodiment of the method for packaging the product inside the product packaging in the display mode, the display aperture includes a plastic window.

In one embodiment of the method for packaging the product inside the product packaging in the display mode, the fastener is operable to secure the top flap and the bottom flap together when the product packaging is in the display mode or the conceal mode.

In one embodiment of the method for packaging the product inside the product packaging in the display mode, the container is a box having a having a display side including the display aperture, a rear side, a top side, a bottom side, a left side, and a right side.

In one embodiment of the method for packaging the product inside the product packaging in the display mode, the top flap and the bottom flap are coupled to the display side of the container.

In one embodiment of the method for packaging the product inside the product packaging in the display mode, the top flap is coupled to the top side of the box and the bottom flap is coupled to the bottom side of the container.

In one embodiment of the method for packaging the product inside the product packaging in the display mode, the top flap includes a top reinforcing portion and the bottom flap includes a bottom reinforcing portion, and the top reinforcing portion reinforces the top side of the box and the bottom reinforcing portion reinforces the bottom side of the box when the top flap and the bottom flap are in display mode.

In one embodiment of the method for packaging the product inside the product packaging in the conceal mode, at least one of the top flap or the bottom flap includes a decorative design visible when the product packaging is in the conceal mode.

In one embodiment of the method for packaging the product inside the product packaging in the conceal mode, the top flap and the bottom flap completely cover the display side when the product packaging is in the conceal mode.

In one embodiment of the method for packaging the product inside the product packaging in the display mode, a tab is extended to couple the product packaging to a product display when extended.

BRIEF DESCRIPTION OF THE DRAWINGS

The same reference number represents the same element on all drawings. It should be understood that the drawings are not necessarily to scale.

DETAILED DESCRIPTION OF THE INVENTION

FIGS. 1-5 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

FIGS. 1-5 depict various views of a product packaging 100 in accordance with an embodiment. Product packaging 100 may be configured to display a product in a display mode or to hide a product in a conceal mode, as will be explained below.

Figure 1:
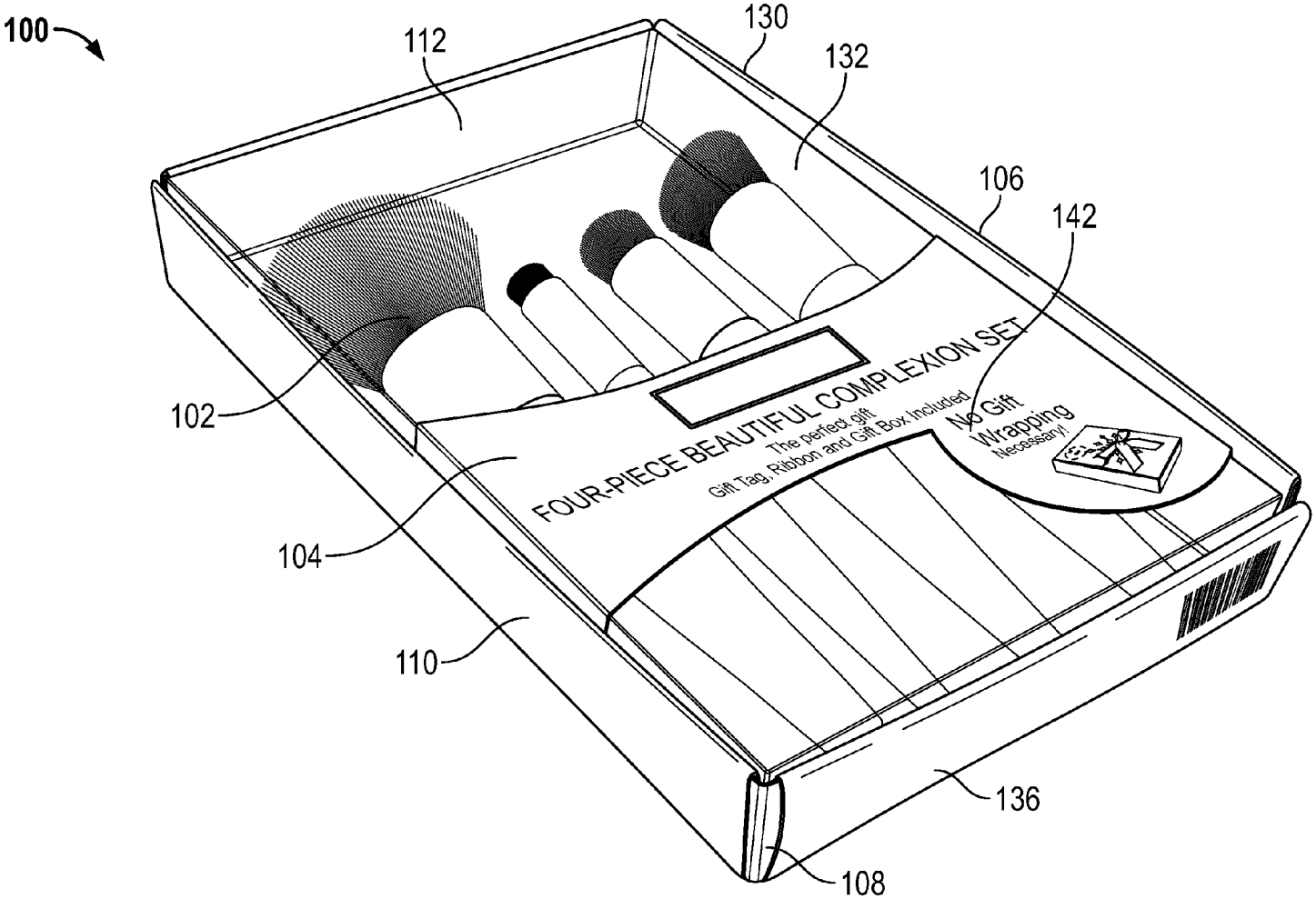
FIG. 1 depicts a perspective view of a product packaging in accordance with an embodiment.
Figure 2:
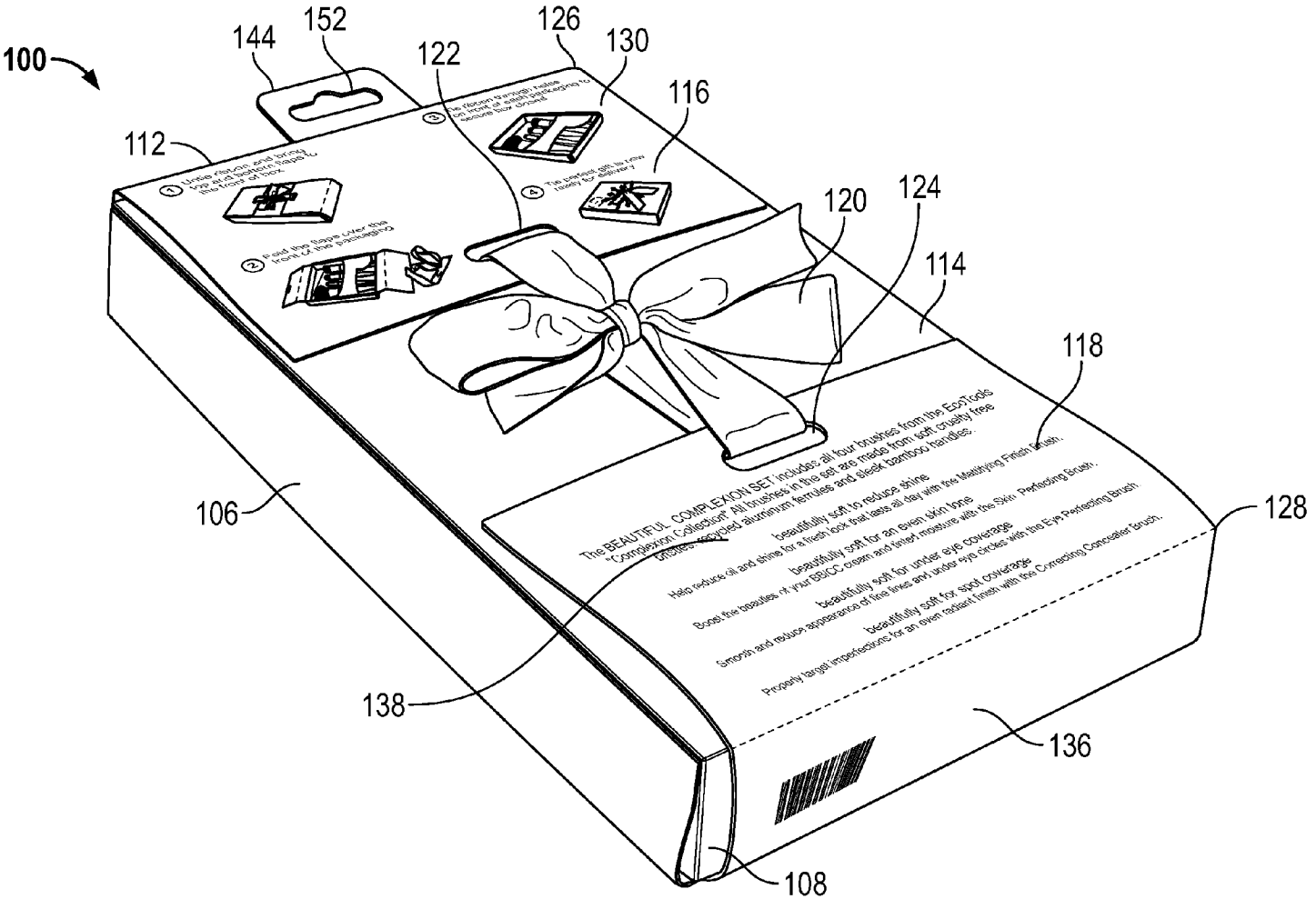
FIG. 2 depicts a perspective view of a product packaging in accordance with an embodiment.
Figure 3:
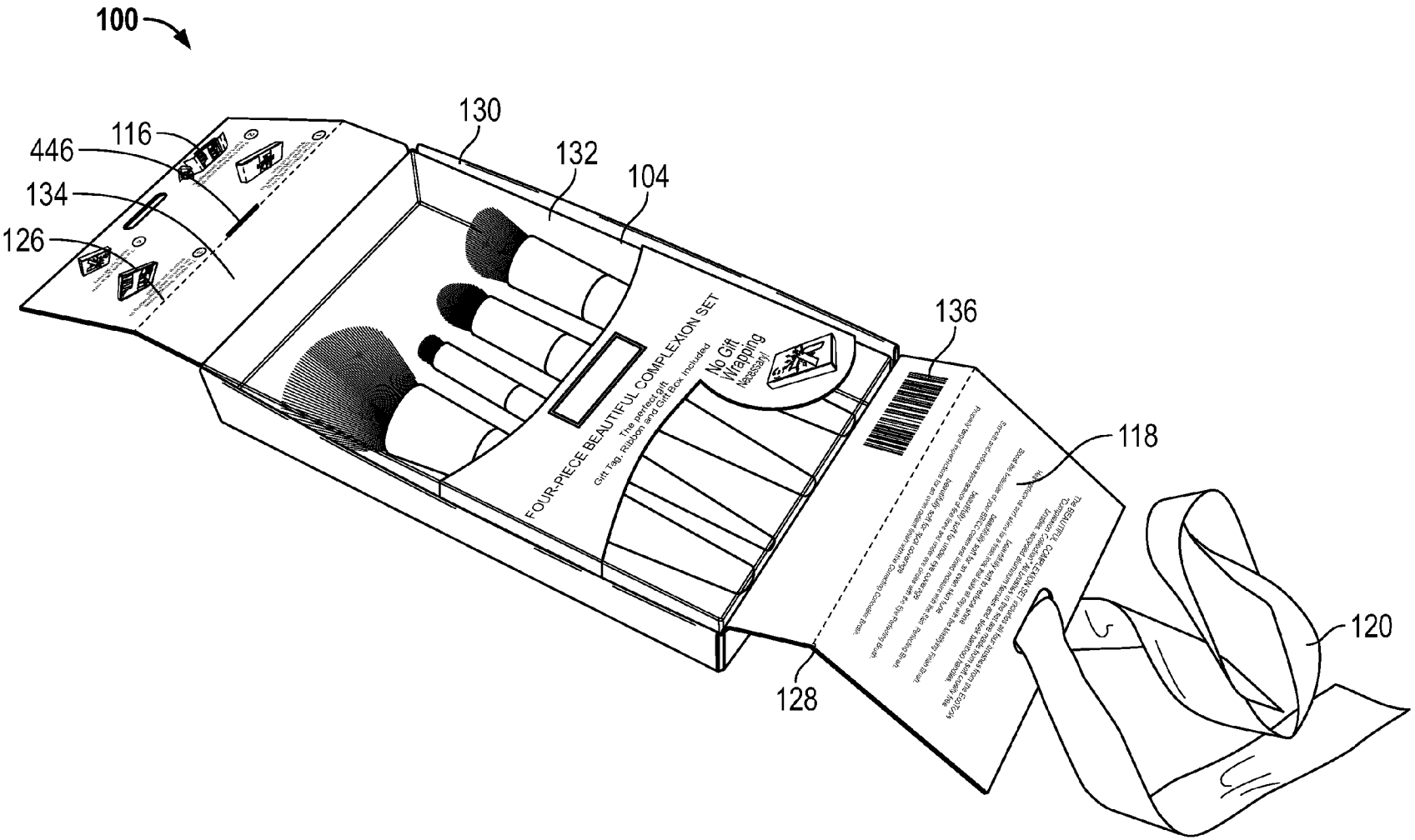
FIG. 3 depicts a perspective view of a product packaging in accordance with an embodiment.
Figure 4:
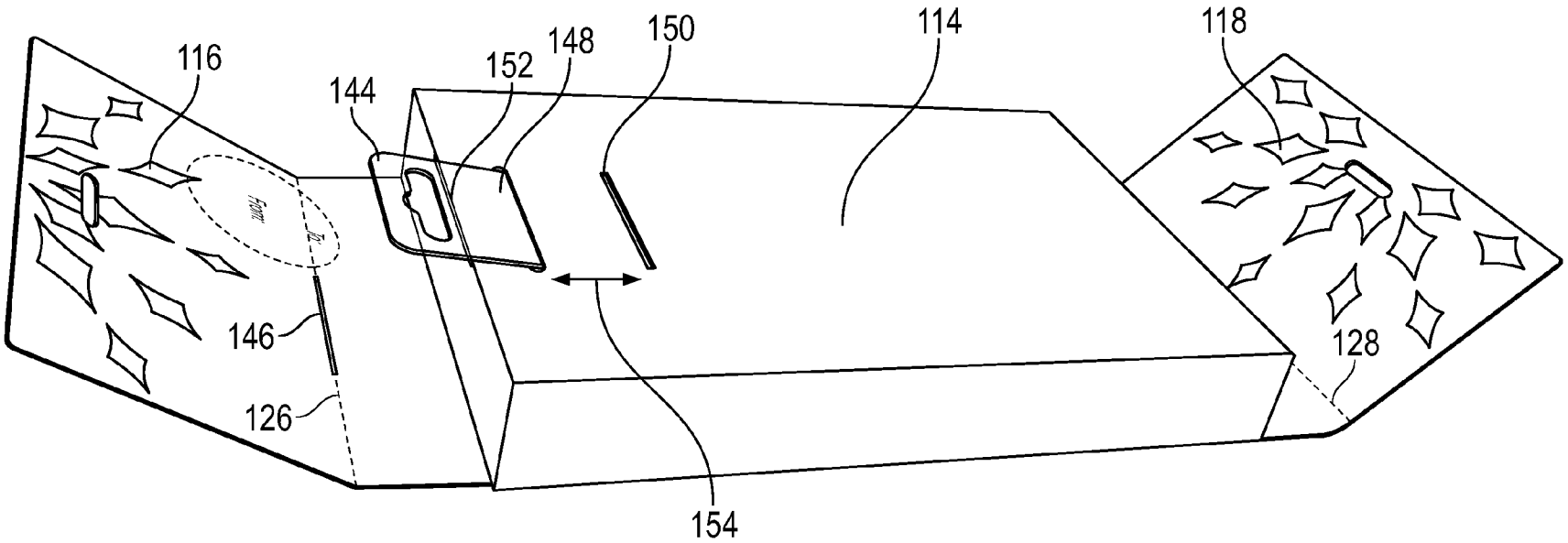
FIG. 4 depicts a perspective view of a product packaging in accordance with an embodiment.
Figure 5:
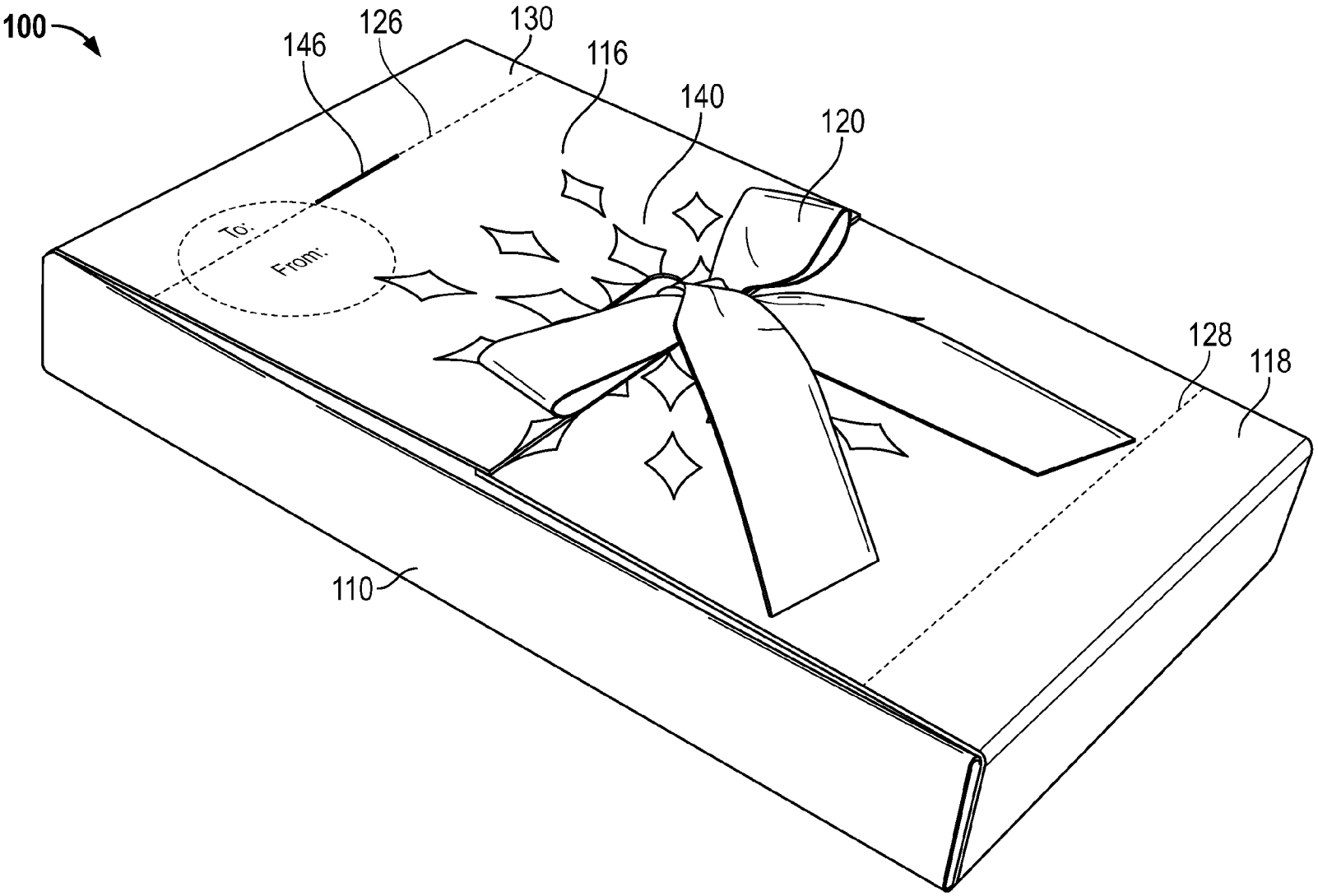
FIG. 5 depicts a perspective view of a product packaging in accordance with an embodiment.

FIGS. 1 and 2 depict perspective views of product packaging 100 in a display mode, with FIG. 1 providing a view of the front of product packaging 100 and FIG. 2 providing a view of the rear of product packaging 100. FIG. 5 depicts a front perspective view of product packaging 100 in a conceal mode. FIGS. 3 and 4 depict views of product packaging 100 in a configuration that are neither the display nor the conceal mode, with FIG. 3 providing a view of the front of product packaging 100 and FIG. 4 providing a view of the rear of product packaging 100.

Product packaging 100 includes a container 130, a display aperture 132, a top flap 116, a bottom flap 118, and a fastener 120, as will be described below. A product 102 may be placed inside product packaging 100. In the example product packaging 100, product 102 includes a set of cosmetic brushes. This is not intended to be limiting, however, as this Application contemplates a product packaging that may retain any type of consumer product.

Display mode for product packaging 100 is depicted in FIGS. 1 and 2. In display mode, top flap 116 and bottom flap 118 cover a portion of container 130 exclusive of display aperture 132, thereby providing a view of product 102 through display aperture 132. In embodiments, product packaging 100 may include product information 138 on top flap 116 or bottom flap 118, product information 138 only being visible when product packaging 100 is in display mode. Fastener 120 may then secure at least one of top flap 116 or bottom flap 118 to retain the product packaging 100 in the display mode. In embodiments, product packaging 100 may further include a tab 144 to couple product packaging 100 to a product display (not pictured).

Conceal mode for product packaging 100 is depicted in FIG. 5. In conceal mode, top flap 116 and bottom flap 118 are configured to cover at least a portion of the display aperture 132. In embodiments, conceal mode may include substantially or completely covering display aperture 132. Product packaging 100 may include a decorative design 140 on top flap 116 or bottom flap 118, decorative design 140 only being visible when product packaging 100 is in conceal mode. Fastener 120 may then secure at least one of top flap 116 or bottom flap 118 to retain the product packaging 100 in the display mode.

Product packaging 100 includes container 130. In the example of product packaging 100, container 130 is a substantially rectangular box that includes a display side 104, a right side 106, a bottom side 108, a left side 110, a top side 112, a rear side 114, a top flap 116, and a bottom flap 118. This is not intended to be limiting, however. In embodiments, container 130 may be formed from non-rectangular shapes capable of being configured into both a display mode and a conceal mode as well. In FIG. 1, display side 104, right side 106, bottom side 108, left side 110, and top side 112 may be seen. In FIG. 2, the top flap 116, bottom flap 118, and rear side 114 may furthermore be seen.

Container 130 may be fabricated from various materials. In embodiments, product packaging 100 may include a single piece of pre-cut and pre-creased material or a combination of materials. For example, product packaging 100 may include a single piece of pre-cut and pre-creased cardboard stock forming right side 106, bottom side 108, left side 110, top side 112, rear side 114, top flap 116, and bottom flap 118. Display side 104 may be formed from a plastic cover 142.

Product packaging 100 further includes display aperture 132 in container 130. Display aperture 132 may provide a view of product 102. In the embodiment of product packaging 100, display aperture 132 spans the entirety of display side 104 and display aperture 132 includes a transparent or semi-transparent window formed from a plastic cover 142 through which product 102 may be viewed. In embodiments, product details and other marketing information may be printed upon display aperture 132, obscuring part of the transparency of display aperture 132. The example of product packaging 100 is not intended to be limiting, however. In embodiments, display side 104 may include a display aperture 132 through which product 102 may be viewed which covers only a portion of display side 104. For example, display side 104 may be formed of cardboard with a display aperture 132 formed as an aperture therein. In embodiments, the display aperture 132 may include a plastic cover or may include no cover at all. Alternatively, clamshell or plastic packaging may be formed tightly around the product 102, viewable through a coverless display aperture 132. Plastic cover 142 may be formed from a separate piece or formed as an integral part of container 130.

Product packaging 100 further includes top flap 116 and bottom flap 118. In FIG. 3, which depicts a configuration of product packaging 100 that is neither the display mode nor the conceal mode, top flap 116 and bottom flap 118 may be seen extending away from product packaging 100. From this configuration, top flap 116 and bottom flap 118 may be easily moved to cover a portion of display aperture 132 in conceal mode, or top flap 116 and bottom flap 118 may be moved to cover a portion of container 130 exclusive of display aperture 132 in display mode. In the example of product packaging 100, it may be seen that top flap 116 is coupled to container 130 along the seam where display side 104 meets top side 112, and bottom side 118 is coupled to container 130 along the seam where display side 104 joins bottom side 108. This is not intended to be limiting, however, as top flap 116 and bottom flap 118 may be coupled to other parts of container 130 as well, including display side 104, right side 106, bottom side 108, left side 110, top side 112, or rear side 114.

In the example product packaging 100, top flap 116 and bottom flap 118 are substantially mirror images of one another, positioned on opposing ends of container 130. The edges of top flap 116 and bottom flap 118 opposite where each of top flap 116 and bottom flap 118 couples to container 130 are adjacent when product packaging 100 is placed in conceal mode to cover display aperture 132. This is not intended to be limiting, however, in embodiments top flap 116 and bottom flap 118 may include different dimensions and closing configurations. Top flap 116 and bottom flap 118 may also be positioned on non-opposing portions of container 130.

In embodiments, top flap 116 and bottom flap 118 may further include product information 138 and/or decorative design 140. For example, from the FIG. 2 depiction of product packaging 100 in display mode, it may be seen that top flap 116 and bottom flap 118 may be printed with product information 138 including marketing information, a product code, and instructions for how to convert product packaging 100 into conceal mode. From the FIG. 5 depiction of product packing 100 in conceal mode, however, decorative design 140 may be visible. Decorative design 140 may include any type of ornamentation that may be appealing to a gift giver or receiver. Advantageously, conceal mode may provide a condition of product packaging 100 that hides product information 138 and provides decoration design 140, which is ideal for gift giving. Display mode may provide product information 138, which is ideal for potential purchasers.

It may be seen from FIG. 3 that top flap 116 may further include a top seam 126 and bottom flap 118 may include a bottom seam 128. Top seam 126 allows the top flap 116 to bend to cover top side 112 and a portion of rear side 114 and bottom seam 128 allows the bottom flap 118 to cover bottom side 108 and a portion of rear side 114 when product packaging 100 is in display mode. The portion of top flap 116 between top seam 126 and the point where top flap 116 couples to container 130 is a top reinforcing portion 134, and the portion of bottom flap 118 between bottom seam 128 and the point where bottom flap 118 couples to container 130 is a bottom reinforcing portion 136. As may be seen in FIGS. 1 and 2, when product packaging 100 is in display mode, top reinforcing portion 134 may provide additional support for top side 112 and bottom reinforcing portion 136 provides support for bottom side 114. Advantageously, this may provide further support and protection for product 102.

Product packaging 100 further includes fastener 120. Fastener 120 may secure at least one of top flap 116 or bottom flap 118 to maintain product packaging 100 in the conceal mode or the display mode. In the example of product packaging 100, fastener 120 is a ribbon. In FIG. 2, it may be seen that top flap 116 includes a top perforation 122 and bottom flap 118 includes a bottom perforation 124. Fastener 120 may be threaded through top perforation 122 and bottom perforation 124 and tied into a bow to secure top flap 116 and bottom flap 118 to one another. This is not intended to be limiting, however, as alternative fasteners are contemplated by this Application. For example, fastener 120 may incorporate a string, a cord, an adhesive, a staple, a magnet, a button, a snap, or a tab/hook feature. Fastener 120 may be formed from a separate material from the box that forms the base of product packaging 100, or fastener 120 may be formed integrally as part of product packaging 100 itself. Product packaging 100 may include one or more fasteners 120. Fastener 120 may be coupled to product packaging 100 via any means known to those of skill in the art, including by threading fastener 120 through perforations in product packaging 100, tying fastener 120 around product packaging 100, or via adhesion to product packaging 100. In embodiments, top flap 116 and bottom flap 118 may be separately fastened directly to display side 104, right side 106, bottom side 108, left side 110, top side 112, or rear side 114. Advantageously, fastener 120 may help top flap 116 and bottom flap 118 maintain substantially flat positions against the exterior of container 130. Fastener 120 may further provide additional decoration when product packaging 100 is in conceal mode.

Product packaging 100 may further include tab 144. Tab 144 may be formed in a substantially flat, rectangular format. In embodiments, tab 144 may include an aperture 152 to couple product packaging 100 to a product display (not shown). Using aperture 152, product packaging 100 may be hung from a display hook, a rack, or any other fixture commonly found in a merchandise display. This is not intended to be limiting, however, as tab 144 may couple product packaging 100 to a product display using any other method known to those in the art.

In embodiments, tab 144 may be configurable between an extended position and a retracted position. For example, FIG. 2 depicts product packaging 100 in display mode with tab 144 in an extended position. In the extended position, tab 144 is accessible to position product packaging 100 on a display. FIG. 5 depicts product packaging 100 in conceal mode with tab 144 in a retracted position. In the retracted position, tab 144 is not visible.

FIG. 4 depicts rear side 114 of product packaging 100 with flaps 116 and 118 resting in an open, unfastened position. Although FIG. 4 depicts tab 144 as extended beyond the perimeter of rear side 114, tab 144 may be moved into a retracted position where tab 144 no longer extends beyond the perimeter of rear side 114. Rear side 114 may include a first slot 148 and a second slot 150 in which the substantially rectangular tab 144 may be positioned. Tab 144 may include a protrusion or stop (not shown) extending from the substantially rectangular body, configured to retain tab 144 within product packaging 100. For example, tab 144 may include a protrusion extending perpendicular to the direction of extension/retraction of tab 144 within product packaging 100. When tab 144 is moved into the extended position, the protrusion may come to rest inside product packaging 100 at first slot 148. When tab 144 is moved into the retracted position, the protrusion may come to rest inside product packaging 100 at second slot 150. Arrow 154 depicts the movement of the tab 144 protrusion between slots 148 and 150.

In embodiments, top flap 116 may further include a tab slot 146 along top seam 126. The extended portion of tab 144 may be inserted through tab slot 146 when product packaging 100 in display mode. Tab slot 146 therefore allows tab 144 to protrude from product packaging 100, as may be seen in the depiction of FIG. 2.

Tab 144 may be formed from plastic, paper, or any other material commonly known to those of skill in the art. Advantageously, tab 144 may therefore be extended for use in a display mode or hidden in a conceal mode.

The product packaging described in the present Application provides the advantages of being easily convertible between a condition that provides product information to a potential purchaser and a condition where the product is in a condition ideal for gift giving. The product packaging described herein is also provides for less waste, which may be desirable for the ecologically aware consumer.

The detailed descriptions of the above embodiments are not exhaustive descriptions of all embodiments contemplated by the inventors to be within the scope of the application. Indeed, persons skilled in the art will recognize that certain elements of the above-described embodiments may variously be combined or eliminated to create further embodiments, and such further embodiments fall within the scope and teachings of the application. It will also be apparent to those of ordinary skill in the art that the above-described embodiments may be combined in whole or in part to create additional embodiments within the scope and teachings of the application.

Thus, although specific embodiments of the application and examples are described herein for illustrative purposes, various equivalent modifications are possible within the scope of the application, as those skilled in the relevant art will recognize. The teachings provided herein can be applied to other devices and method, and not just to the embodiments described above and shown in the accompanying figures. Accordingly, the scope of the application should be determined from the claims.

I claim:

1. A product packaging (100) comprising:

a container (130);

a display aperture (132) in the container (130);

a top flap (116) directly coupled to the container (130);

a bottom flap (118) directly coupled to the container (130), the top flap (116) and the bottom flap (118) each being configurable to either cover a portion of the container (130) exclusive of the display aperture (132) when the product packaging (100) is in a display mode, or to cover a portion of the display aperture (132) when the product packaging (100) is in a conceal mode; and a fastener (120) coupled to at least one of the top flap (116) or the bottom flap (118), the fastener (120) operable to secure at least one of the top flap (116) and the bottom flap (118) when the product packaging (100) in the display mode or the conceal mode.

2. The product packaging (100) of claim 1, wherein at least one of the top flap (116) or the bottom flap (118) includes product information (138) visible when the product packaging (100) is in the display mode.

3. The product packaging (100) of claim 1, wherein at least one of the top flap (116) or the bottom flap (118) includes a decorative design (140) visible when the product packaging (100) is in the conceal mode.

4. The product packaging (100) of claim 1, wherein the display aperture (132) includes a plastic cover (142).

5. The product packaging (100) of claim 1, wherein the top flap (116) and the bottom flap (118) substantially cover the display aperture (132) when the product packaging (100) is in the conceal mode.

6. The product packaging (100) of claim 1, wherein the fastener (120) is operable to secure the top flap (116) and the bottom flap (118) together when the product packaging (100) is in the display mode or the conceal mode.

7. The product packaging (100) of claim 1, wherein the container (130) is a box including a display side (104) having the display aperture (132), a rear side (114), a top side (112), a bottom side (108), a left side (110), and a right side (106).

8. The product packaging (100) of claim 7, wherein the top flap (116) is coupled to the top side (112) of the container (130) and the bottom flap (118) is coupled to the bottom side (108) of the container (130).

9. The product packaging (100) of claim 8, wherein the top flap (116) includes a top reinforcing portion and the bottom flap (118) includes a bottom reinforcing portion (136), and the top reinforcing portion (134) supporting the top side (112) of the container (130) and the bottom reinforcing portion (136) supporting the bottom side (108) of the container (130) when the product packaging (100) is in display mode.

10. The product packaging (100) of claim 1, further comprising:

a tab (144) operable to couple the product packaging (100) to a product display when extended.

* * * * *